US010699853B2

(12) United States Patent
Huang et al.

(10) Patent No.: US 10,699,853 B2
(45) Date of Patent: Jun. 30, 2020

(54) KEY STRUCTURE

(71) Applicant: ASUSTeK COMPUTER INC., Taipei (TW)

(72) Inventors: Meng-Chu Huang, Taipei (TW); Tong-Shen Hsiung, Taipei (TW); Jau-Yi Wu, Taipei (TW); Li-Wei Yu, Taipei (JP); Chen-Hou Lo, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 16/148,093

(22) Filed: Oct. 1, 2018

(65) Prior Publication Data

US 2019/0103236 A1 Apr. 4, 2019

(30) Foreign Application Priority Data

Oct. 3, 2017 (TW) ..... 106134274 A

(51) Int. Cl.
*H01H 13/705* (2006.01)
*H01H 3/12* (2006.01)
*H01H 13/88* (2006.01)

(52) U.S. Cl.
CPC ..... *H01H 3/122* (2013.01); *H01H 13/705* (2013.01); *H01H 13/88* (2013.01); *H01H 3/125* (2013.01); *H01H 2217/024* (2013.01); *H01H 2221/066* (2013.01); *H01H 2229/062* (2013.01)

(58) Field of Classification Search
CPC .... H01H 3/125; H01H 13/83; H01H 13/7065; H01H 13/705; H01H 2221/04; H01H 13/14; H01H 3/12; H01H 3/122; H01H 13/88; H01H 2221/066; H01H 2229/062; H01H 2217/024
See application file for complete search history.

(56) References Cited

U.S. PATENT DOCUMENTS 5,183,346 A * 2/1993 Tesar ..... B41J 5/10 400/490
8,927,884 B2 1/2015 Shih et al.
9,870,880 B2 1/2018 Zercoe et al.
(Continued)

FOREIGN PATENT DOCUMENTS

CN 202126940 U 1/2012
CN 102938338 A 2/2013
(Continued)

OTHER PUBLICATIONS

Office Action issued in corresponding Taiwan patent application dated Feb. 14, 2019.
(Continued)

*Primary Examiner* — Ahmed M Saeed
(74) *Attorney, Agent, or Firm* — McClure, Qualey & Rodack, LLP

(57) ABSTRACT

A key structure includes a movable support element, a keycap, and a fitting portion. The keycap includes a top surface, a bottom surface, and a rim, the bottom surface is jointed with the movable support element, and a periphery of the top surface extends downward to form the rim. The fitting portion is located on the rim, and operated by an operation body to separate the keycap from the movable support element.

8 Claims, 17 Drawing Sheets

(56) References Cited

U.S. PATENT DOCUMENTS

| | | | | |
|---|---|---|---|---|
| 2015/0047959 | A1* | 2/2015 | Wu | H01H 3/125<br>200/344 |
| 2016/0189891 | A1 | 6/2016 | Zercoe et al. | |

FOREIGN PATENT DOCUMENTS

| | | | |
|---|---|---|---|
| CN | 205201426 | U | 5/2016 |
| CN | 205920911 | U | 2/2017 |
| CN | 106981386 | A | 7/2017 |
| CN | 206516538 | U | 9/2017 |
| TW | 201312619 | A | 3/2013 |

OTHER PUBLICATIONS

Office Action issued in corresponding Taiwan patent application dated May 7, 2019.

* cited by examiner

KEY STRUCTURE

CROSS-REFERENCE TO RELATED APPLICATION

This application claims the priority benefit of Taiwan application serial No. 106134274, filed on Oct. 3, 2017. The entirety of the above-mentioned patent application is hereby incorporated by reference herein and made a part of specification.

BACKGROUND OF THE INVENTION

Field of the Invention

This disclosure relates to a key structure.

Description of the Related Art

The keys on keyboards are easily damaged after a long term use. The damaged keys need to be replaced. On the market, there are products used to assist in pulling out the keys like a key puller. When a key puller is used, usually, a foot portion of the key puller needs to stretch from a bottom end of a key into the interior of the key, then the foot portion hooks an inner surface of the key, and finally the key is pulled out. However, in such an operation process, the key puller needs to be inclined at an angle to stretch into the interior of the key, and holds in an upright angle to pull out the key. That is, sufficient space for the key puller to be operated is required. Consequently, it is inconvenient to use the key puller and in certain conditions, the usage of the key puller is limited.

BRIEF SUMMARY OF THE INVENTION

The disclosure provides a key structure, including a movable support element, a keycap, and a fitting portion. The keycap includes a top surface, a bottom surface, and a rim, the bottom surface is jointed with the movable support element, and a periphery of the top surface extends downward to form the rim. The fitting portion is located on the rim, and is operated by an operation body to separate the keycap from the movable support element.

In this way, the operation body corresponds to the operation portion on the rim to clamp the keycap, and it is more convenient for usage.

DETAILED DESCRIPTION OF THE EMBODIMENTS

Figure 1:
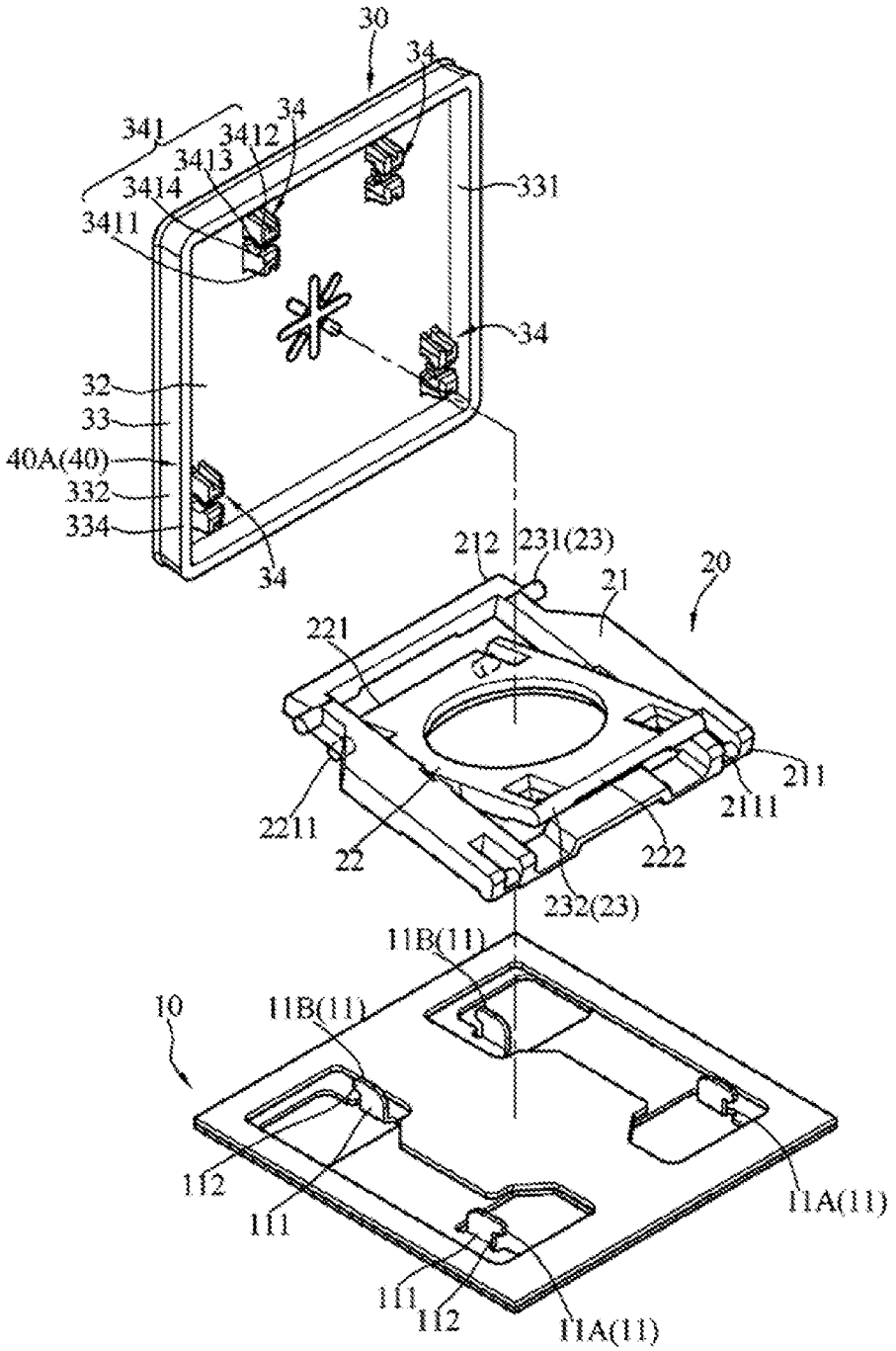
FIG. 1 is a schematic exploded view of a three-dimensional structure of an embodiment of a key structure according to the disclosure.
Figure 2:
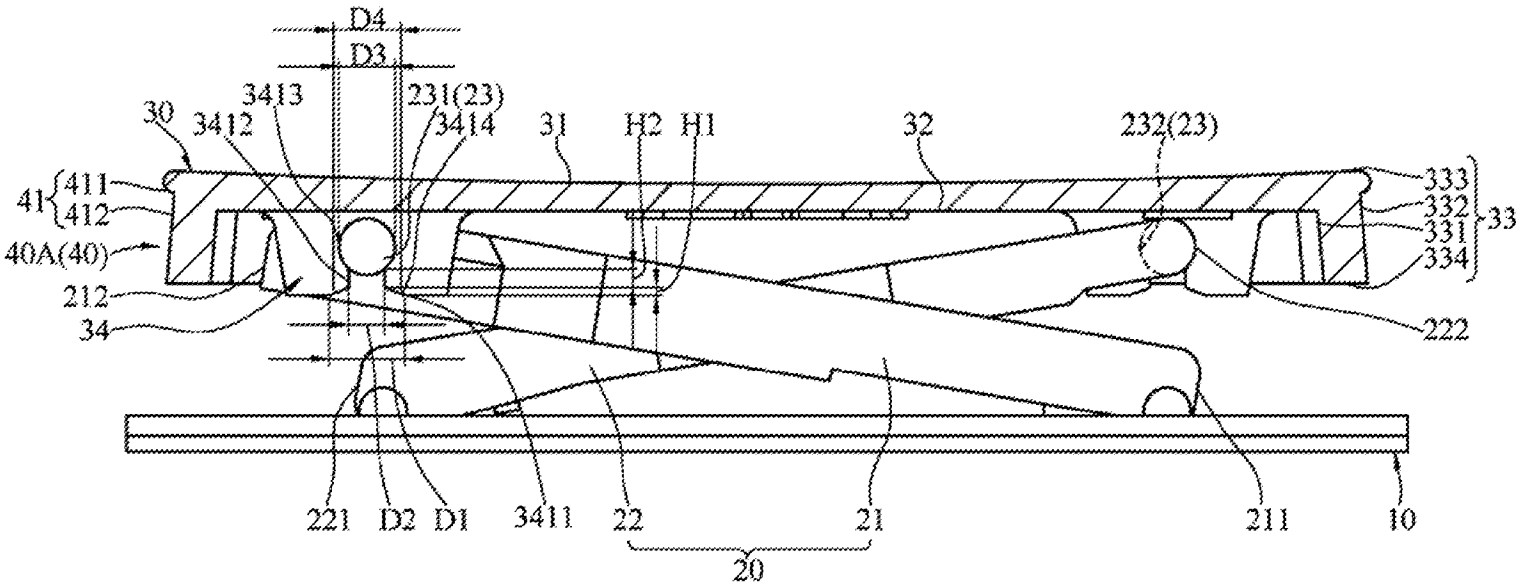
FIG. 2 is a partial sectional view of a combined state of an embodiment of a key structure according to the disclosure.

Referring to FIG. 1 and FIG. 2, FIG. 1 is a schematic exploded view of a three-dimensional structure of an embodiment of a key structure according to the disclosure; and FIG. 2 is a partial sectional view of a combined state of an embodiment of a key structure according to the disclosure. The key structure shown in FIG. 1 and FIG. 2 includes a baseboard 10, a movable support element 20, a keycap 30, and a fitting portion 40.

In an embodiment, referring to FIG. 1 and FIG. 2, the movable support element 20 of the key structure is disposed on the baseboard 10, and the keycap 30 is jointed with the movable support element 20 and abuts against the movable support element 20 to elastically move. The keycap 30 includes a top surface 31, a bottom surface 32, and a rim 33, the top surface 31 is opposite to the bottom surface 32, and the rim 33 extends from peripheries of the top surface 31 and the bottom surface 32 to a side.

The fitting portion 40 is disposed at the rim 33 and is used to contact with the operation body, so that the operation body operates and applies a force. The operation body is fingers of a user or a key puller A. When the operation body contacts with the fitting portion 40 to apply a force in a direction away from the baseboard 10, the fitting portion 40 corresponds to the operation body and generates a counter-force in a direction facing the baseboard 10, to limit the operation body to separate in a direction away from the baseboard 10. In this way, the operation body cooperates with the fitting portion 40 and detaches the keycap 30 without stretching into an interior of the keycap 30, so that convenience of an operation is improved.

In an embodiment, the baseboard 10 is disposed in a keyboard housing and used to bear a thin film circuit, the movable support element 20 and the keycap 30. Referring to FIG. 1, the baseboard 10 includes a plurality of fixing hooks 11. In this embodiment, there are four fixing hooks 11 within two first fixing hooks 11A and two second fixing hooks 11B.

Referring to FIG. 1 again, each fixing hook 11 is L-shaped and includes a first body segment 111 and a second body segment 112, one end of the first body segment 111 is connected to the baseboard 10, and one end of the second body segment 112 is connected to the other end of the first body segment 111. Further, the first body segment 111 extends in a direction perpendicular to the baseboard 10, and the second body segment 112 extends in a direction parallel to the baseboard 10. Therefore, the second body segments 112 of the two first fixing hooks 11A are parallel to each other, and the second body segments 112 of the two second fixing hooks 11B are parallel to each other.

In an embodiment, a minimum distance between the second body segments 112 of the two first fixing hooks 11A is greater than a minimum distance between the second body segments 112 of the two second fixing hooks 11B. In addition, the second body segment 112 of the first fixing hook 11A extends in a direction facing one side of the baseboard 10, and the second body segment 112 of the second fixing hook 11B extends in a direction facing the other side of the baseboard 10. In this way, the first fixing hook 11A and the second fixing hook 11B are opened and facing opposite directions.

Referring to FIG. 1 and FIG. 2, in an embodiment, the movable support element 20 includes a first support member 21 and a second support member 22. The first support member 21 is rectangular, the first support member 21 includes a first fixed side 211 and a first connecting side 212 opposite to each other, and the first fixed side 211 includes two first fixed portions 2111. The first fixed portions 2111 of the first fixed side 211 of the first support member 21 are disposed between the second body segments 112 of the two first fixing hooks 11A and the baseboard 10. In this way, the first support member 21 is limited by the second body segments 112 of the first fixing hooks 11A.

Referring to FIG. 1 and FIG. 2 again, in an embodiment, the second support member 22 is rectangular, and an outer outline of the second support member 22 is smaller than an inner outline of the first support member 21. In this way, the second support member 22 is accommodated in the inner outline of the first support member 21. The second support member 22 includes a second fixed side 221 and a second connecting side 222 opposite to each other, and the second fixed side 221 includes two second fixed portions 2211.

The second fixed portions 2211 of the second fixed side 221 of the second support member 22 are disposed between the second body segments 112 of the two second fixing hooks 11B and the baseboard 10. In this way, the second support member 22 is limited by the second body segments 112 of the second fixing hooks 11B. Therefore, the second fixed side 221 of the second support member 22 is close to the first connecting side 212, and the second connecting side 222 is close to the first fixed side 211, so that the first support member 21 and the second support member 22 are crossed to form an X shape. In addition, positions on the outer outline of the second support member 22 between the second fixed side 221 and the second connecting side 222 are pivotably disposed on the inner outline of the first support member 21. In this way, the first support member 21 and the second support member 22 pivotably rotate with respect to each other.

Referring to FIG. 1 and FIG. 2 again, in an embodiment, the keycap 30 is jointed with the movable support element 20 and abuts against the movable support element 20 to elastically move. The movable support element 20 includes a connecting portion 23. The keycap 30 includes a joint portion 34 movably jointed with the connecting portion 23 in a direction perpendicular to the bottom surface 32.

The connecting portion 23 includes two first connecting portions 231 and two second connecting portions 232, the two first connecting portions 231 are located on the first connecting side 212, and the two second connecting portions 232 are located on the second connecting side 222. The keycap 30 is movably jointed with the movable support element 20 in a single direction between the first connecting portion 231 on the first connecting side 212 and the second connecting portion 232 on the second connecting side 222.

Further referring to FIG. 1 and FIG. 2, the keycap 30 includes the top surface 31, the bottom surface 32, and the rim 33, the top surface 31 is opposite to the bottom surface 32, and the rim 33 extends from peripheries of the top surface 31 and the bottom surface 32 to a side. Further, the bottom surface 32 of the keycap 30 includes joint portions 34 that are used to be jointed with the movable support element 20.

Similarly, referring to FIG. 1 and FIG. 2 again, in an embodiment, each joint portion 34 includes a pinch portion 341, and the pinch portion 341 includes a nip 3411, a neck segment 3412, and a positioning segment 3413 that are in communication connection with each other sequentially.

The first connecting portion 231 and the second connecting portion 232 of the movable support element 20 include a round rod structure. Therefore, length extension directions of the first connecting portion 231 and the second connecting portion 232 are parallel to the bottom surface 32.

The joint portion 34 is made of a material with deformation capability, for example, a plastic material, a rubber material, or a silica gel material. In this case, the pinch portion 341 of the joint portion 34 generates deformation under a force, and recovers to an original state after the force disappears.

Referring to FIG. 2 again, in a direction parallel to the bottom surface 32, a diameter of the nip 3411 is D1, a neck segment width of the neck segment 3412 is D2, and a positioning width of the positioning segment 3413 is D3. The diameter D1 of the nip 3411 is greater than the neck segment width D2 and the positioning width D3, the neck segment width D2 is less than the positioning width D3, and the positioning width D3 is equivalent to an outer diameter of the first connecting portion 231 or the second connecting portion 232.

In this case, when the keycap 30 is to be mounted on the movable support element 20, the joint portion 34 of the keycap 30 sleeves on the first connecting portion 231 or the second connecting portion 232 by using the nip 3411 with the largest width, and then a force is applied on the keycap 30, so that the joint portion 34 generates a deformation and causes the first connecting portion 231 or the second connecting portion 232 to pass through the neck segment 3412 and enter the positioning segment 3413 for positioning.

After the first connecting portion 231 or the second connecting portion 232 passes through the neck segment 3412 and enters the positioning segment 3413, when no force is applied on the keycap 30, the joint portion 34 recovers to the original state and causes the neck segment 3412 to recover to a state in which the neck segment 3412 is smaller than the outer diameter of the first connecting portion 231 or the second connecting portion 232. In this case, the first connecting portion 231 or the second connecting portion 232 is stably limited, and the keycap 30 is in a stable joint state.

On the contrary, when the keycap 30 is to be removed, a force is applied on the keycap 30 in a direction away from the baseboard 10, so that a part between the joint portion 34 of the keycap 30 and the first connecting portion 231 or the second connecting portion 232 deforms due to the force, and the neck segment 3412 expands when pressed by the first connecting portion 231 or the second connecting portion 232, so that the first connecting portion 231 or the second connecting portion 232 passes through the neck segment 3412. The keycap 30 is pulled out by a force applied on the keycap 30 in a direction away from the baseboard 10.

In addition, there is a bevel 3414 between the nip 3411 and the neck segment 3412. In a direction parallel to the bottom surface 32, a bevel width of any position in the bevel 3414 is D4, and the closer a position is to the neck segment 3412, the smaller the bevel width D4 becomes. The neck segment 3412 linearly extends in a direction perpendicular to the bottom surface 32.

In this case, when the keycap 30 sleeves on the first connecting portion 231 or the second connecting portion 232 by using the joint portion 34, because the diameter D1 of the nip 3411 is greater than the outer diameter of the first connecting portion 231 or the second connecting portion 232, the first connecting portion 231 or the second connecting portion 232 easily enters the nip 3411.

After the first connecting portion 231 or the second connecting portion 232 enters the nip 3411, the first connecting portion 231 or the second connecting portion 232 is guided by the bevel 3414 between the nip 3411 and the neck segment 3412 and gradually moves in a direction towards the neck segment 3412, and the continuously varying bevel 3414 gradually guides the first connecting portion 231 or the second connecting portion 232 to enter from the nip 3411 with a largest width to the neck segment 3412 with a smallest width. In this way, installation smoothness is improved when the keycap 30 is installed.

Further, in a direction perpendicular to the bottom surface 32, there is a nip depth H1 between the nip 3411 and the neck segment 3412, there is a neck segment depth H2 between two ends of the neck segment 3412, and a sum of the nip depth H1 and the neck segment depth H2 is less than or equal to one half the positioning width D3.

In this case, when the first connecting portion 231 or the second connecting portion 232 passes through the neck segment 3412, because the neck segment depth H2 is less than the positioning width D3, that is, the neck segment depth H2 is less than the outer diameter of the first connecting portion 231 or the second connecting portion 232, the first connecting portion 231 or the second connecting portion 232 is not completely accommodated in the neck segment 3412. In this case, when the keycap 30 is assembled, a maximum range of assembling resistance is deceased, and assembling difficulty is further decreased, thereby improving assembling convenience.

It is learned from the foregoing description that, the keycap 30 is pulled out or assembled by moving away from or towards the movable support element 20 in a single direction. Thus, the efficiency of assembling and disassembling the keycap 30 is significantly improved.

Referring to FIG. 1 and FIG. 2, further, the fitting portion 40 is disposed on the rim 33 and used by the operation body to operate and pull out the keycap 30. Therefore, the rim 33 further includes an inner surface 331 and an outer surface 332 opposite to each other, the inner surface 331 is connected to the bottom surface 32, and the outer surface 332 is connected to the top surface 31.

The fitting portion 40 contacting the rim 33 is located on the outer surface 332, so the fitting portion 40 pulls the keycap 30 out directly without stretching into the interior of the keycap 30 from a bottom side of the keycap 30. Therefore, the keycap 30 is not only pulled out by using the key puller A, but also is pulled out by a hand of a user. The operation convenience is improved. In addition, when an operation manner in which the key puller A does not need to stretch into the bottom side of the keycap 30 is used, space is reduced, and limits on layouts of the key structure on the keyboard are reduced.

Referring to FIG. 2 again, more specifically, the rim 33 includes a top end 333 and a bottom end 334 that are opposite to each other, and the top end 333 is connected to the top surface 31. Therefore, the top end 333 and the top surface 31 are coplanar, the bottom end 334 is one end of the rim 33 away from the top surface 31, and the fitting portion 40 is located between the top end 333 and the bottom end 334.

In this case, the operation body pulls the keycap 30 out without stretching into the interior of the keycap 30 from the bottom side of the keycap 30, and the fitting portion 40 located between the top end 333 and the bottom end 334 of the rim 33 further provide more visual operation positions, and similarly further improve convenience in use.

Figure 3:
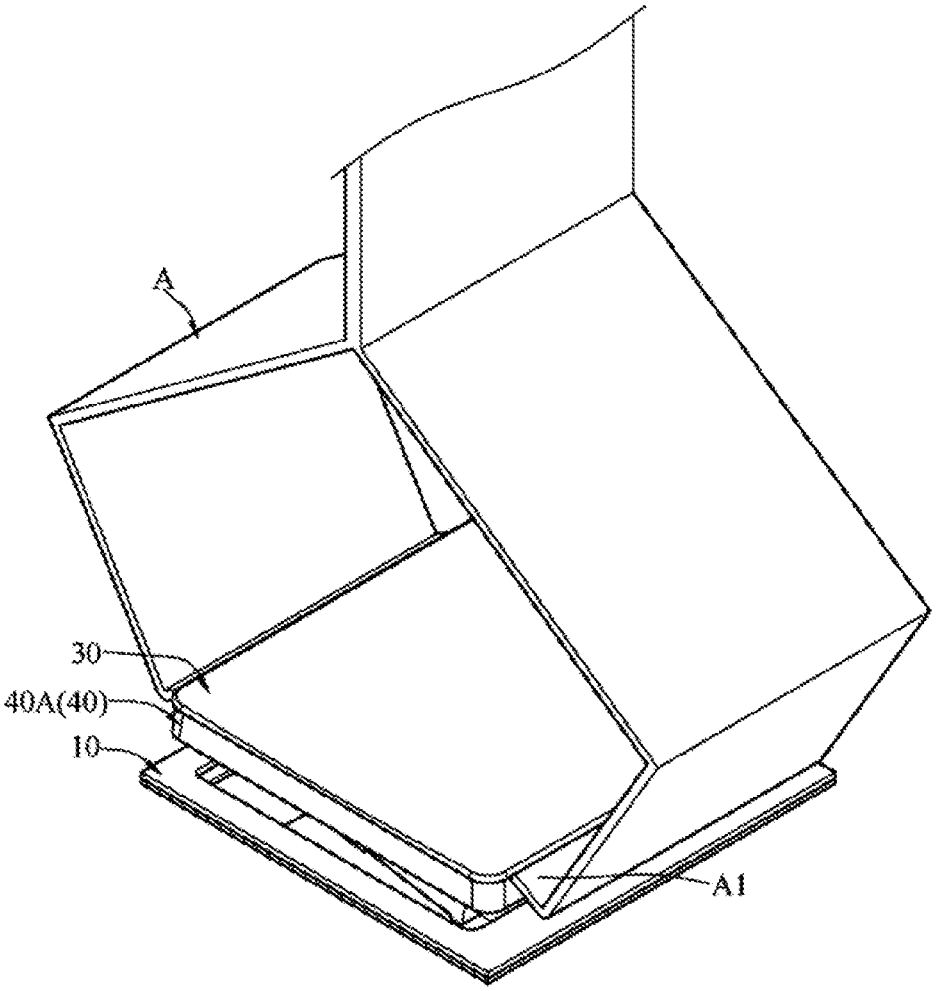
FIG. 3 is a schematic diagram showing that an embodiment of a key structure of the disclosure is used in cooperation with a key puller.

Referring to FIG. 3, FIG. 3 shows an implementation aspect in which the fitting portion 40 is used in cooperation with an operation body that is a key puller A to pull the keycap 30 out. The key puller A includes at least two opposite foot portions A1, and the foot portions A1 are in a sheet structure, a strip structure, or a column structure. The foot portions A1 of the key puller A are jointed with the keycap 30 and correspond to the fitting portion 40. When the keycap 30 is to be pulled out, a force is applied on the key puller A to pull the keycap 30 out and separate the keycap 30 from the movable support element 20. Certainly, the operation body that is a hand of a user can directly contact with the keycap 30 in this embodiment and pull the keycap 30 out.

Referring to FIG. 2 and FIG. 3, in an embodiment, the fitting portion 40 is a groove 40A, and the groove 40A is a single groove 40A or a combination of a plurality of grooves 40A. Therefore, the groove 40A includes a groove inner surface 41, and the groove inner surface 41 is located between the top end 333 and the bottom end 334 of the rim 33. The groove inner surface 41 is a single flat surface, a combination of a plurality of flat surfaces, a single-arc surface, or a combination of a plurality of arc surfaces.

In an embodiment, referring to FIG. 1 to FIG. 3, the groove 40A is a single groove 40A defined by a plurality of groove inner surfaces 41. The plurality of groove inner surfaces 41 includes a first flat surface 411 and a second flat surface 412 connected to each other, and the groove 40A in this embodiment extends to the entire periphery of the keycap 30. Therefore, an extension direction of the first flat surface 411 is perpendicular to an extension direction of the second flat surface 412, the second flat surface 412 is parallel to the inner surface 331 of the rim 33, and the second flat surface 412 extends to the bottom end 334 of the rim 33.

Therefore, an operation in which the keycap 30 is pulled out by using the operation body that is the key puller A is used as an example. The foot portions A1 of the key puller A stretch into the groove 40A. In this case, when the key puller A applies a force in a direction away from the movable support element 20, the foot portions A1 of the key puller A are retained by the first flat surface 411 of the groove 40A, and actually apply the force on the keycap 30 by using the first flat surface 411 of the groove 40A, so that the keycap 30 is pulled out in the direction away from the movable support element 20.

Figure 4:
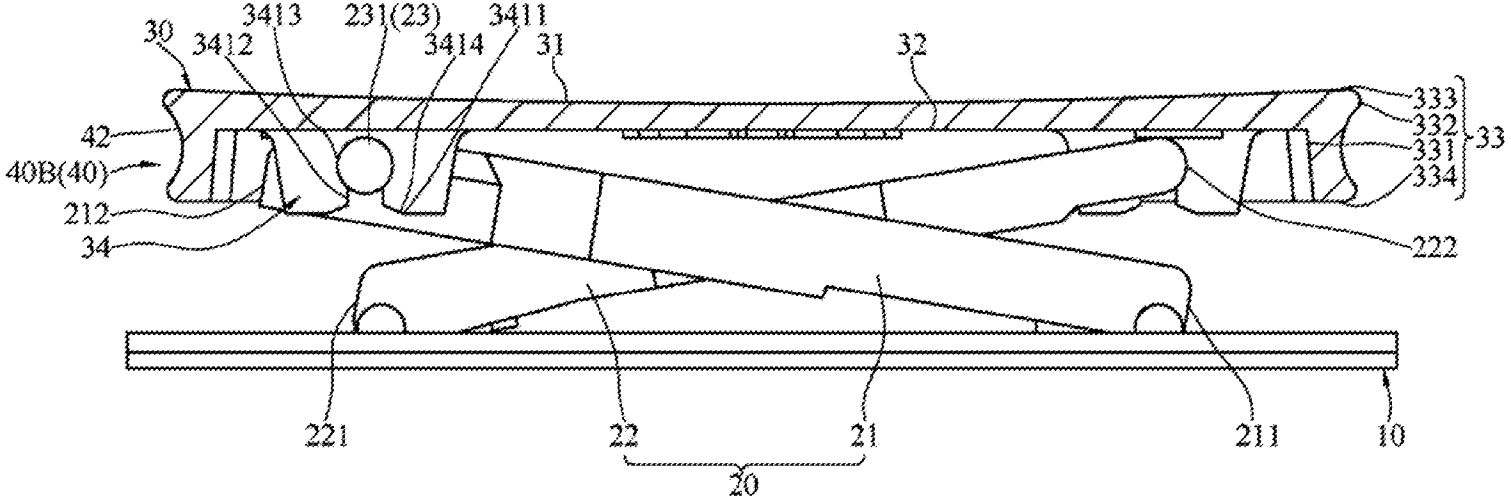
FIG. 4 is a partial sectional view of a combined state of another embodiment of a key structure according to the disclosure.
Figure 5:
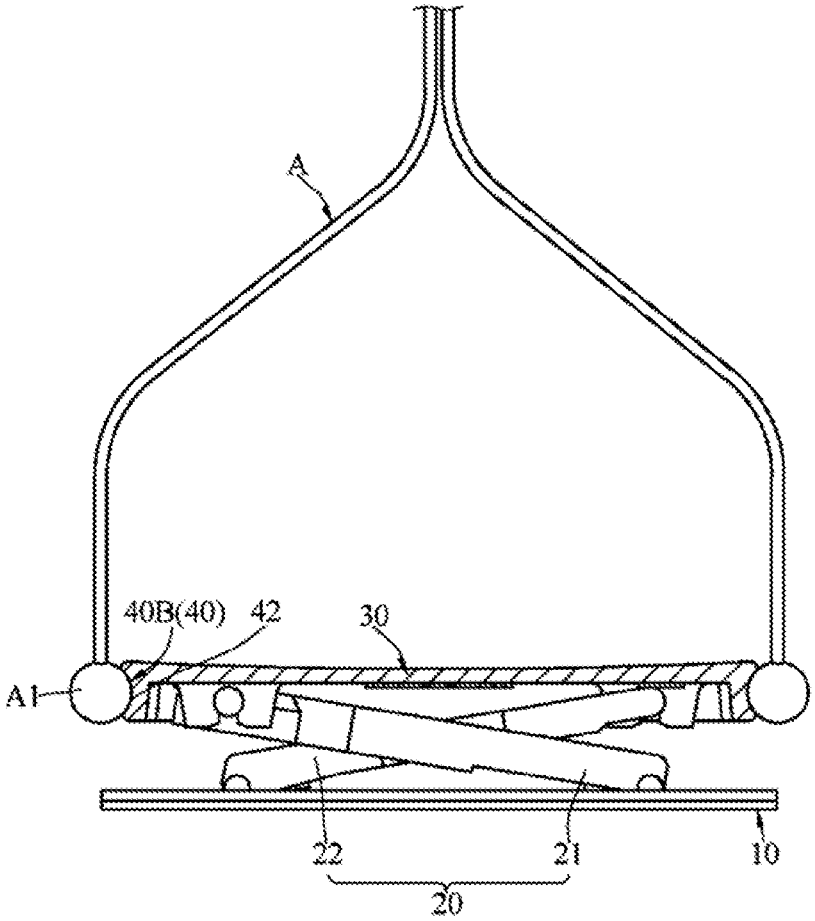
FIG. 5 is a planar diagram of a use state of the key structure in FIG. 4.

Referring to FIG. 4 and FIG. 5, in an embodiment, the fitting portion 40 is a groove 40B. The groove 40B is a single groove 40B defined by a single groove inner surface 42. The groove inner surface 42 is an arc surface, two ends of the groove inner surface 42 are located between the top end 333 and the bottom end 334 of the rim 33, and the groove 40B in this embodiment extends to the entire periphery of the keycap 30. In this embodiment, the foot portions A1 of the key puller A are a cylinder structure or a spherical structure, and the arc surfaces of the foot portions A1 of the key puller A correspond to the groove inner surface 42 of the fitting portion 40B. In this way, operation requirements of different key pullers A are met, and certainly, the fitting portion 40B is also applicable to an operation in which the hand of the user directly applies a force.

Figure 6:
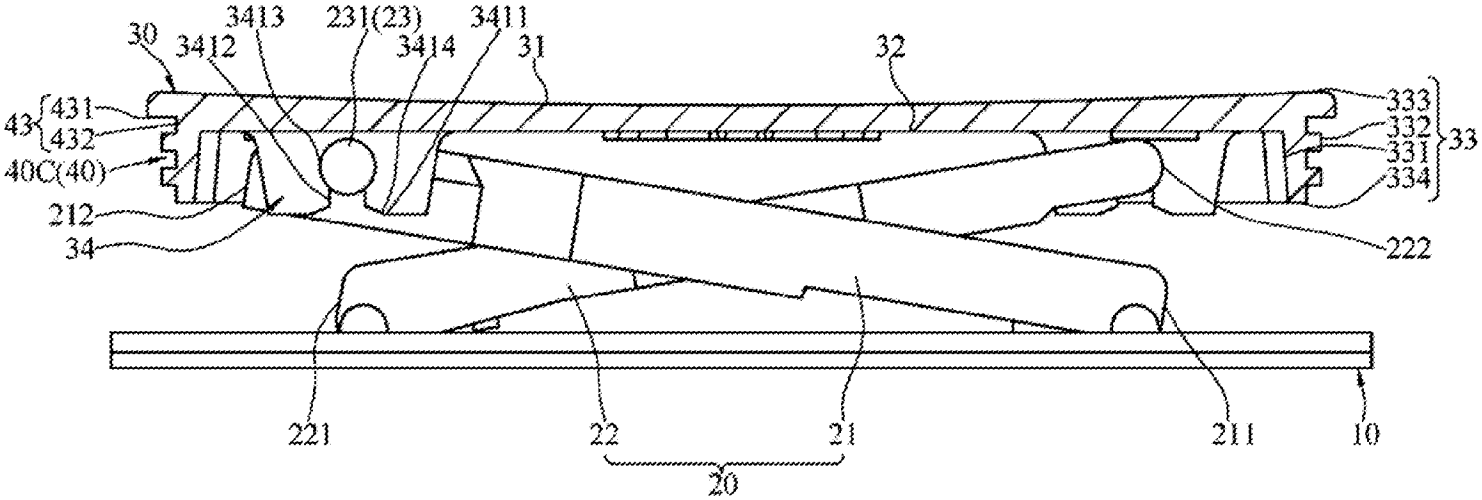
FIG. 6 is a schematic diagram of an embodiment in which a fitting portion of a key structure according to the disclosure is a plurality of grooves.

Referring to FIG. 6, in an embodiment, the fitting portion 40 is a plurality of grooves 40C defined by a plurality of groove inner surfaces 43. The grooves 40C in this embodiment extend to the entire periphery of the keycap 30. The plurality of groove inner surfaces 43 includes a plurality of first flat surfaces 431 and a plurality of second flat surfaces 432. Therefore, an extension direction of the first flat surface 431 is perpendicular to an extension direction of the second flat surface 432, two ends of the second flat surface 432 are separately connected to the first flat surfaces 431, and the two first flat surfaces 431 and the second flat surface 432 between the two first flat surfaces 431 define the grooves 40C.

The plurality of grooves 40C is disposed at intervals and distributed between the top end 333 and the bottom end 334 of the rim 33. Therefore, the foot portions A1 of the key puller A stretch into the grooves 40C to pull the keycap 30 out, and the plurality of grooves 40C provide different positions corresponding to the key puller A to enhance flexibility and convenience in use. In this embodiment, when the operation body is the hand of the user, a larger friction force is provided, so that the user stably applies a force, thereby enhancing operation convenience.

Figure 7:
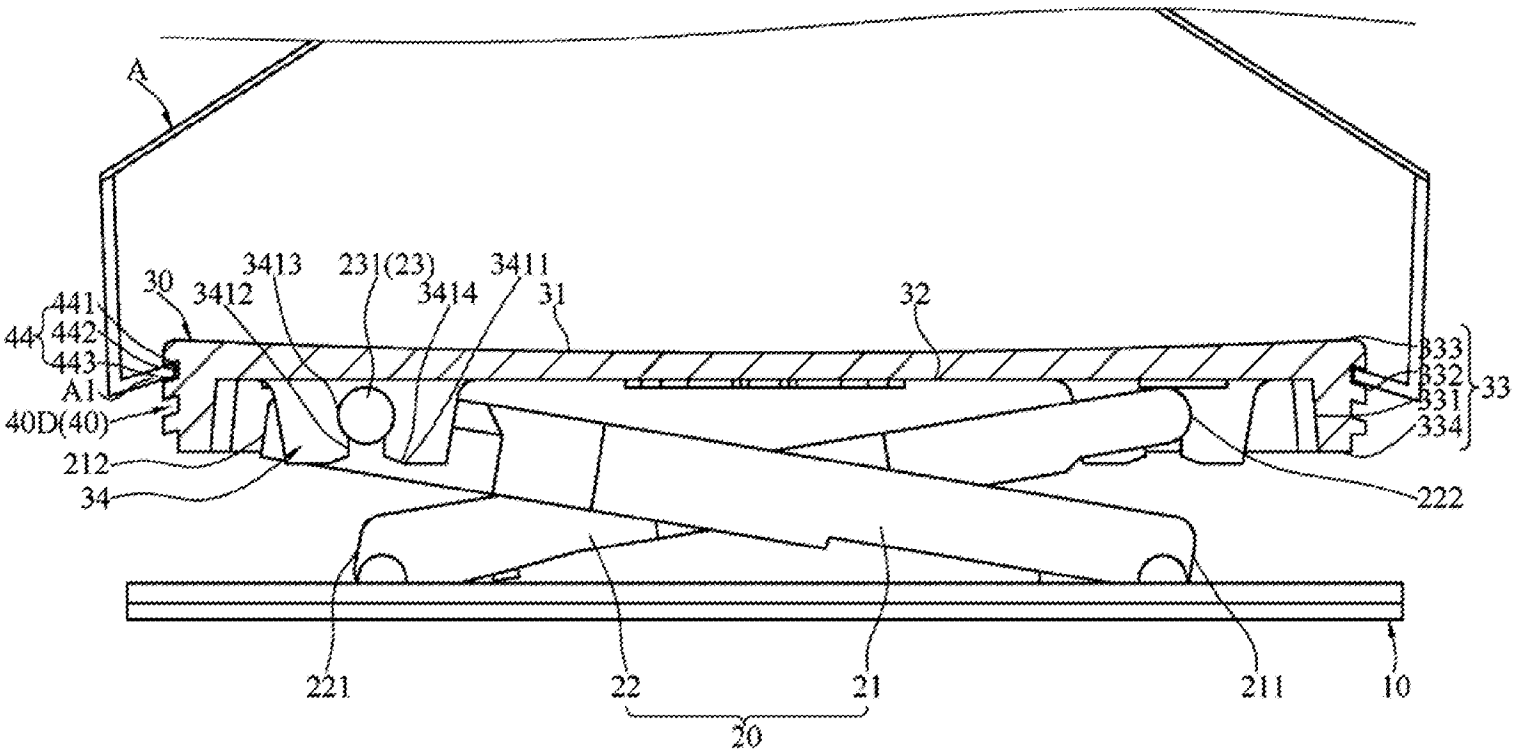
FIG. 7 is a use state diagram of another embodiment in which a fitting portion of a key structure according to the disclosure is a plurality of grooves.

In addition, referring to FIG. 7, in an embodiment, the fitting portion 40 is a groove 40D defined by a plurality of groove inner surfaces 44. The grooves 40D in this embodiment extend to the entire periphery of the keycap 30. Each groove 40D includes a first flat surface 441, a second flat surface 442, and a third flat surface 443, and the first flat surface 441 is closer to the top surface 31 relative to the third flat surface 443.

An angle between the first flat surface 441 and the second flat surface 442 is less than 90 degrees, an angle between the second flat surface 442 and the third flat surface 443 is greater than 90 degrees, and the first flat surface 441 is parallel to the third flat surface 443. The groove 40D is defined between the first flat surface 441, the second flat surface 442, and the third flat surface 443. Therefore, when the foot portions A1 of the key puller A stretch into the groove 40D to pull the keycap 30 out, the foot portions A1 of the key puller A correspondingly stretch into the angle that is formed by the first flat surface 441 and the second flat surface 442 and that is less than 90 degrees, so that a separation-proof effect is further obtained. In this embodiment, when the operation body is the hand of the user, a larger friction force is provided, so that the user stably applies a force, thereby enhancing operation convenience.

Figure 8:
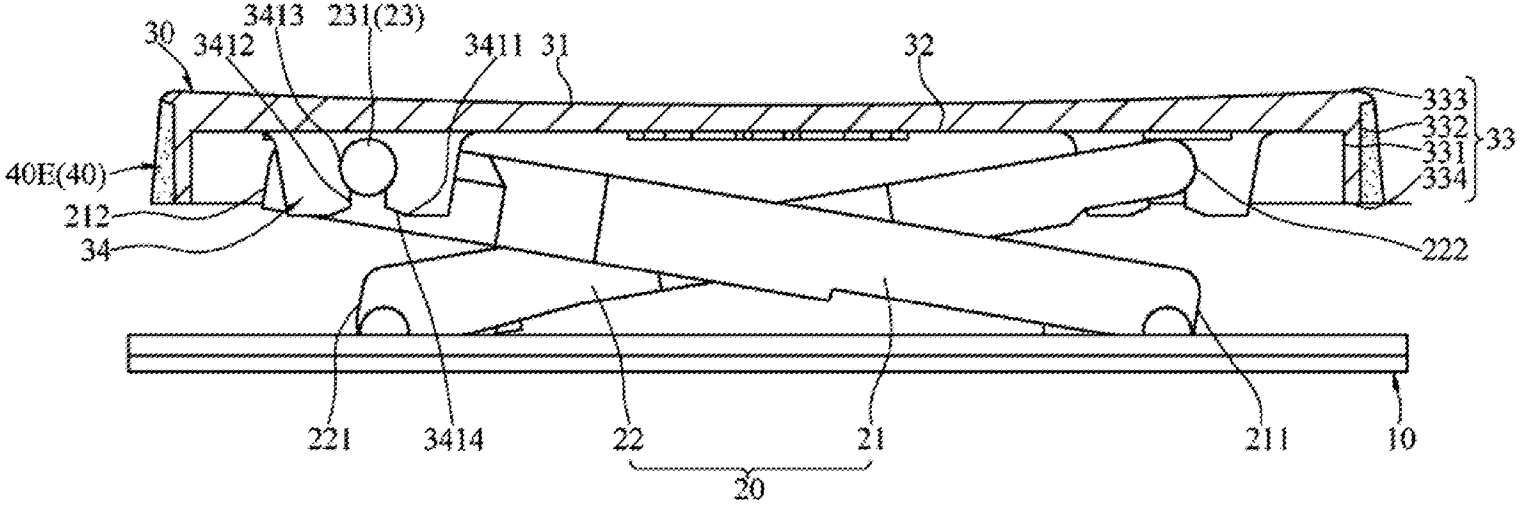
FIG. 8 is a schematic diagram of an embodiment in which a fitting portion of a key structure according to the disclosure is antiskid bodies.

Moreover, referring to FIG. 8, in an embodiment, the fitting portion 40 is an antiskid body 40E. The antiskid body 40E is disposed on the outer surface 332 of the rim 33 and located between the top end 333 and the bottom end 334. A friction force of the antiskid body 40E is greater than a friction force of the keycap 30, and the antiskid body 40E in this embodiment extends to the entire periphery of the keycap 30. In addition, a difference in the friction force between the antiskid body 40 and the keycap 30 is caused by difference materials or structures. For example, the antiskid body 40 is made of a rubber material, and the keycap 30 is made of plastic material. Alternatively, the antiskid body 40 is a structure with an unsmooth surface, and the keycap 30 is a structure with a smooth surface.

Therefore, when the key puller A or the hand of the user is used to pull the keycap 30 out, the foot portions A1 of the key puller A or the hand of the user contacts with the antiskid body 40E on the rim 33, and the antiskid body 40E provides a relatively large friction force for the key puller A or the hand of the user, so that the force of the operator is more actually applied on the keycap 30, and the keycap 30 is more effectively pulled out.

Figure 9:
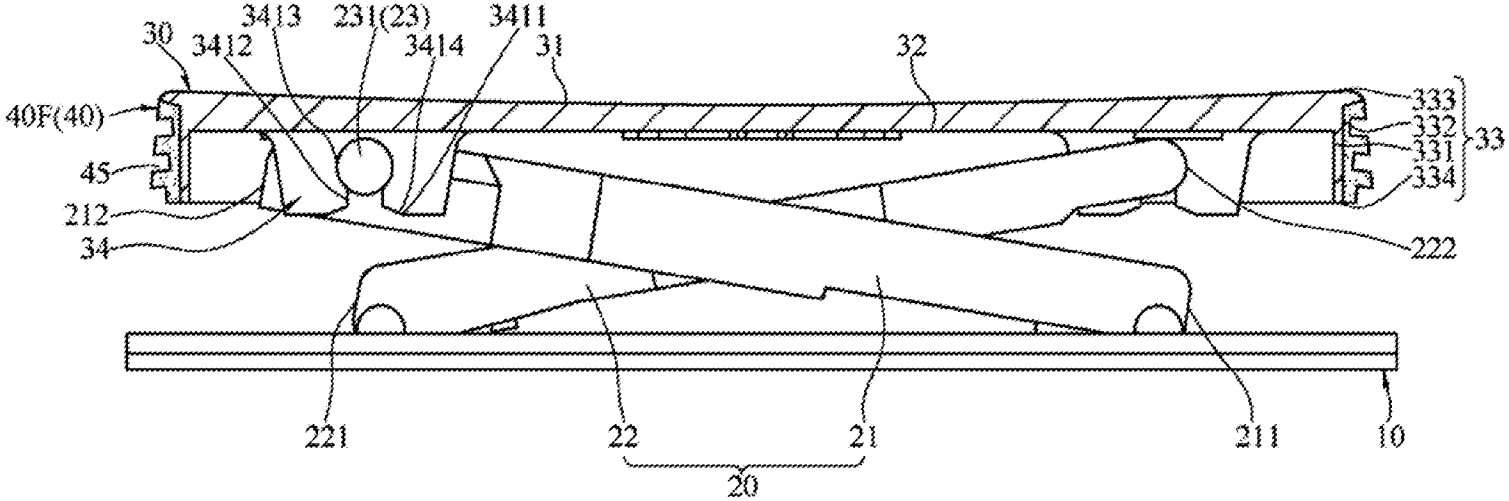
FIG. 9 is a schematic diagram of another embodiment in which a fitting portion of a key structure according to the disclosure is antiskid bodies.

Further, referring to FIG. 9, in an embodiment, the fitting portion 40 is an antiskid body 40F, a groove 45 is further provided on the antiskid body 40F, and the antiskid body 40F in this embodiment extends to the entire periphery of the keycap 30. In this case, when the foot portions A1 of the key puller A or the hand of the user contacts with the antiskid body 40F, the antiskid body 40F not only provides a separation-proof effect for the foot portions A1 or the hand of the user, but also correspondingly forces the foot portions A1 into the groove 45, so that the groove 45 retains the foot portions A1, thereby providing a more actual and stable operation feeling.

Figure 10:
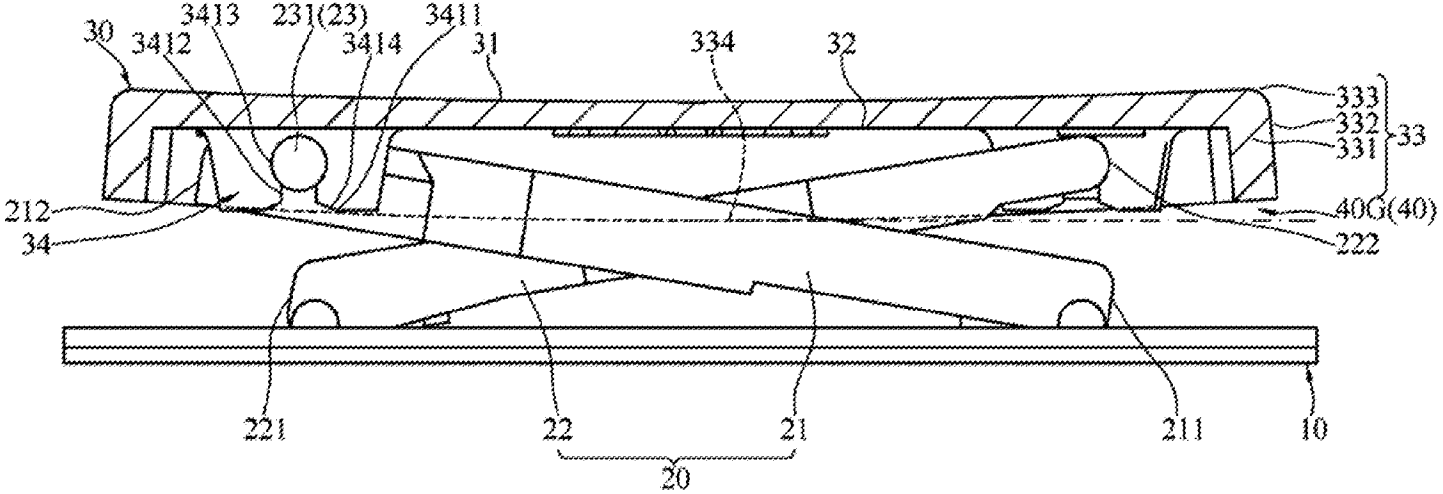
FIG. 10 is a schematic diagram of an embodiment in which a fitting portion of a key structure according to the disclosure is notches.

In addition, referring to FIG. 10, in an embodiment, the fitting portion 40 is a notch 40G. Therefore, outlines of the top surface 31 and the bottom surface 32 of the keycap 30 are rectangular. Therefore, the top surface 31 and the bottom surface 32 of the keycap 30 each include four sides, the rim 33 is disposed around the four sides, and a length of a part of the rim 33 on two opposite sides is greater than a length of a part of the rim 33 on the other two opposite sides. In this case, there is a height difference between a bottom end 334 of the part of the rim 33 with a relatively long length and a bottom end 334 of the part of the rim 33 with a relatively short length. When the bottom end 334 of the rim 33 of the keycap 30 is disposed on the flat surface, the notch 40G is defined between the part of the rim 33 with relatively a short length and the flat surface, and the notch 40G is located between a top end 333 and the bottom end 334 of the part of the rim 33 with a relatively long length, that is, the notch 40G is open at the bottom end 334 to which the notch 40G extends. Therefore, the foot portions A1 of the key puller A or the hand of the user pulls the keycap 30 out from the notch 40G.

Figure 11:
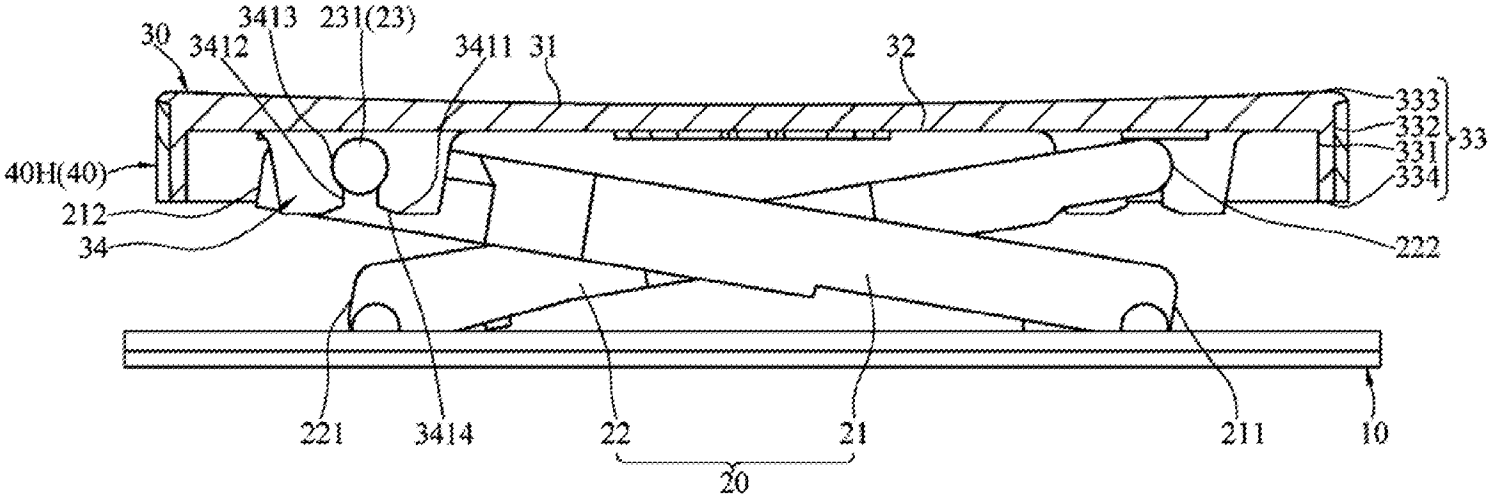
FIG. 11 is a schematic diagram of an embodiment in which a fitting portion of a key structure according to the disclosure is magnetic elements.

In addition, referring to FIG. 11, in an embodiment, the fitting portion 40 is a magnetic element 40H. The magnetic element 40H is disposed on the outer surface 332 of the rim 33 and located between the top end 333 and the bottom end 334. The magnetic element 40H includes a magnetic attraction force. Therefore, when a key puller A made of a metal material is used to pull the keycap 30 out, foot portions A1 of the key puller A clamp on the magnetic element 40H of the rim 33, and the magnetic element 40H attracts the key puller A by using a magnetic attraction force. In this way, the key puller A stably clamps the keycap 30, thereby facilitating pulling the keycap 30 out.

Figure 12:
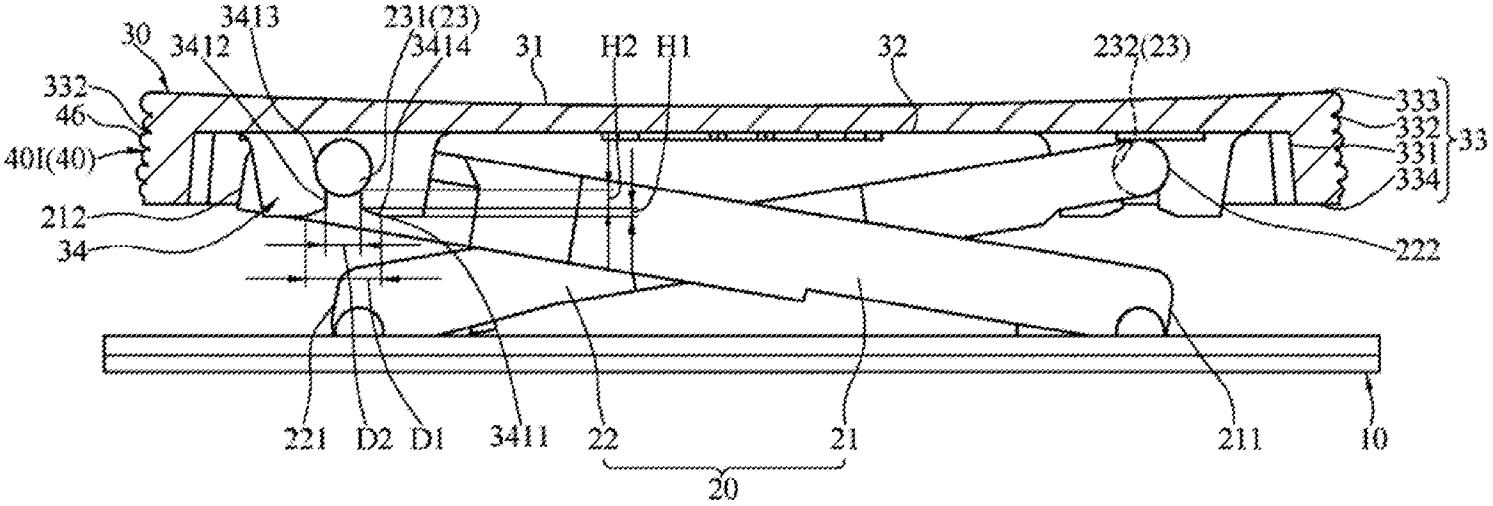
FIG. 12 is a schematic diagram of an embodiment in which a fitting portion of a key structure according to the disclosure is protrusions.

Referring to FIG. 12, in an embodiment, the fitting portion 40 is a protrusion 40I. The protrusion 40I includes a protruded surface 46, and the protruded surface 46 protrudes on the outer surface 332 of the rim 33. It is not limited that protrusions 40I are in a same shape or different shapes, and the protrusions 40I are regularly or irregularly arranged on the outer surface 332 of the rim 33. The protruded surface 46 of the protrusion 40I is not limited to an arc surface or a flat surface. The protrusion 40I increase a friction force of the outer surface 332 of the rim 33.

Therefore, when the key puller A or the hand of the user is used to pull the keycap 30 out, the foot portions A1 of the key puller A or the hand of the user clamps on the protrusions 40I on the rim 33, and the protrusion 40I provides a relatively large friction force for the key puller A or the hand of the user, so that the force of the operator is more actually applied on the keycap 30, and the keycap 30 is more effectively pulled out.

Figure 13:
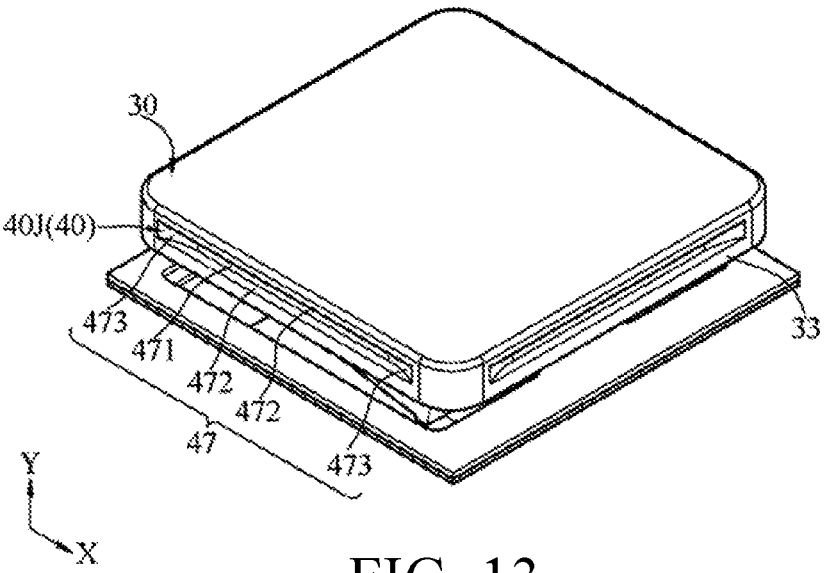
FIG. 13 is a schematic diagram of an embodiment in which a fitting portion of a key structure according to the disclosure is grooves and is disposed at a position between corners.

Further, referring to FIG. 13, in an embodiment, the rim 33 of the keycap 30 is approximately rectangular and includes four corners 335, and the fitting portion 40 is located at a position between the corners 335. Therefore, the fitting portion 40 is a groove 40J defined by a plurality of groove inner surfaces 47, and the groove inner surface 47 includes a first flat surface 471, two second flat surfaces 472, and two arc surfaces 473. An extension direction of the first flat surface 471 is perpendicular to an extension direction of the second flat surface 472, and ends of the two arc surfaces 473 are connected to two ends of the first flat surface 471.

Therefore, a shortest connection direction between the top end 333 and the bottom end 334 of the rim 33 of the keycap 30 is defined as an up-to-down direction Y. Two ends of each of the arc surfaces 473 are at positions in the same up-to-down direction Y. A radian of each arc surface 473 varies at positions of the same up-to-down direction Y. That is, some positions of each arc surface 473 in a horizontal direction X perpendicular to the up-to-down direction Y linearly extend in the up-to-down direction Y. In this case, the foot portions A1 of the key puller A or the hand of the user stretches into the groove 40J to pull the keycap 30 out, the groove 40J retains the key puller A or the hand of the user from easily separating from the keycap 30, and the user directly applies a force on the arc surfaces 473 at two ends of the groove 40J, rather than applying a force on a sharp angle, thereby improving user experience.

Figure 14:
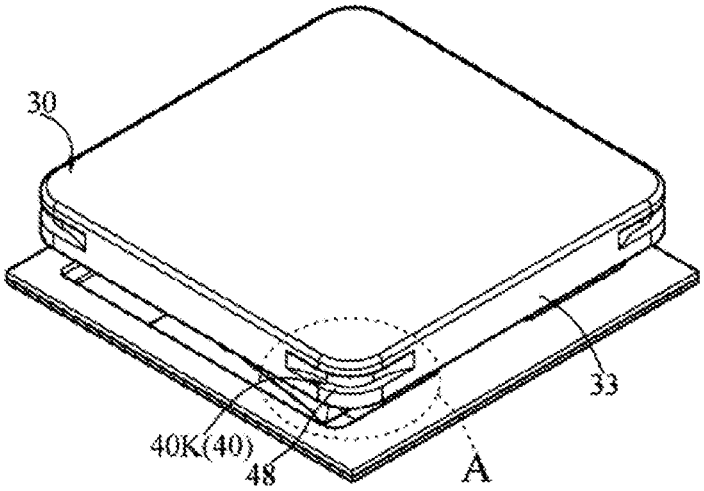
FIG. 14 is a schematic diagram of an embodiment in which a fitting portion of a key structure according to the disclosure is grooves and is disposed at corners.
Figure 15:
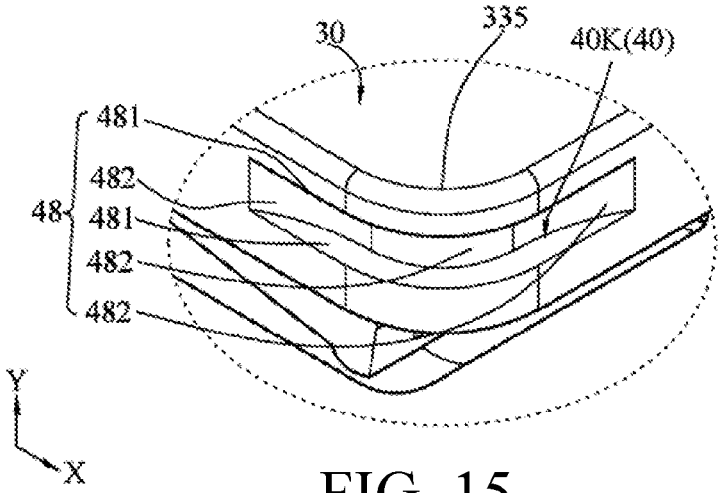
FIG. 15 is a partially enlarged diagram of a circle A in FIG. 14.

Referring to FIG. 14 and FIG. 15, in an embodiment, an outline of the keycap 30 is approximately rectangular and includes four corners 335. In this case, the fitting portion 40 is a groove 40K defined by a plurality of groove inner surfaces 48, and the groove 40K is located at each corner 335. Therefore, the groove 40K includes two flat surfaces 481 and a plurality of arc surfaces 482. Extension directions of the two flat surfaces 481 are parallel to the top surface 31 of the keycap 30, the two flat surfaces 481 are spaced and parallel to each other, and the arc surfaces 482 are connected between the two flat surfaces.

More specifically, this embodiment includes three arc surfaces 482, and two ends of the three arc surfaces 482 form an angle of approximately 90 degrees. Radians of the three arc surfaces 482 are varied at positions in the same up-to-down direction Y. A same position in the horizontal direction X on the three arc surfaces 482 linearly extends in the up-to-down direction Y. In this way, the foot portions A1 of the key puller A or the hand of the user applies a force on the groove K at the four corners 335 corresponding to the keycap 30, so that use requirements in different space are met, and the arc surfaces 482 forming the groove 40K provide more comfortable use feelings.

Figure 16:
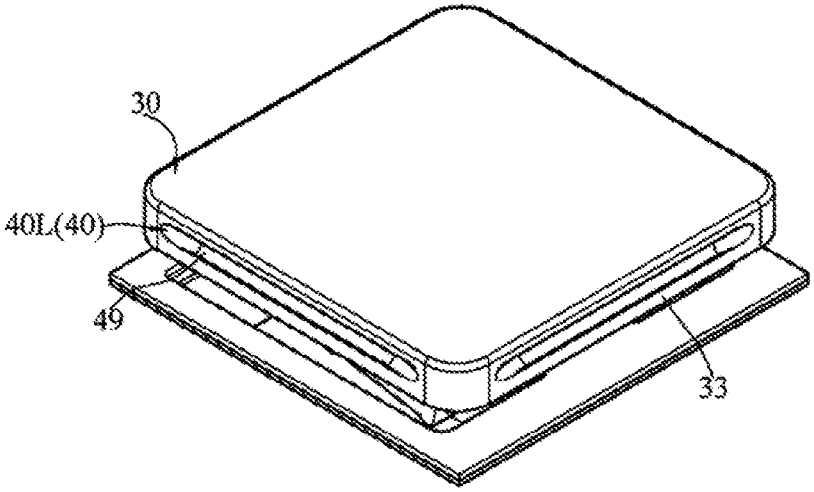
FIG. 16 is a schematic diagram of another embodiment in which a fitting portion of a key structure according to the disclosure is grooves and is disposed at a position between corners.

Referring to FIG. 16, in an embodiment, the fitting portion 40 is a groove 40L defined by a groove inner surface 49. Therefore, the groove inner surface 49 is a single and continuous arc surface, that is, an inner surface of the entire groove 40L is an arc surface. In this case, the foot portions A1 of the key puller A or the hand of the user stretches into the groove 40L to pull the keycap 30 out, the groove 40L retains the key puller A or the hand of the user from easily separating from the keycap 30, and the user directly applies a force on the single-arc groove inner surface 49 of the groove 40L, rather than applying a force on a sharp angle, thereby improving degrees of comfort in use.

Figure 17:
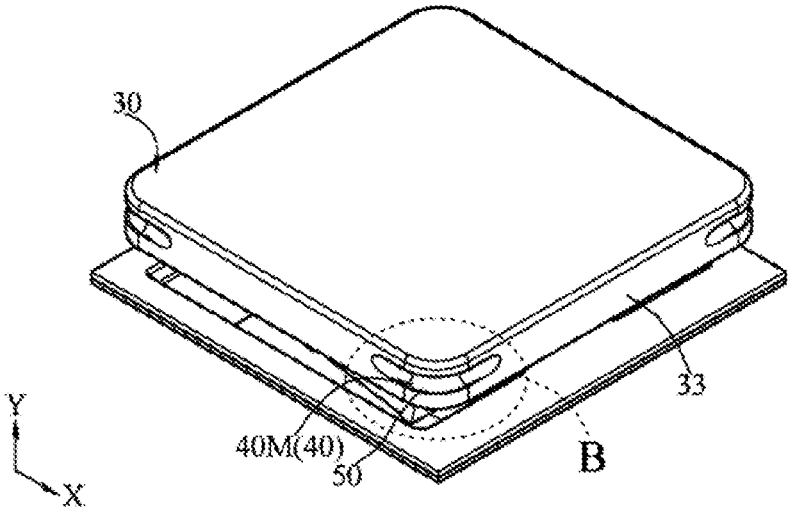
FIG. 17 is a schematic diagram of another embodiment in which a fitting portion of a key structure according to the disclosure is grooves and is disposed at corners.
Figure 18:
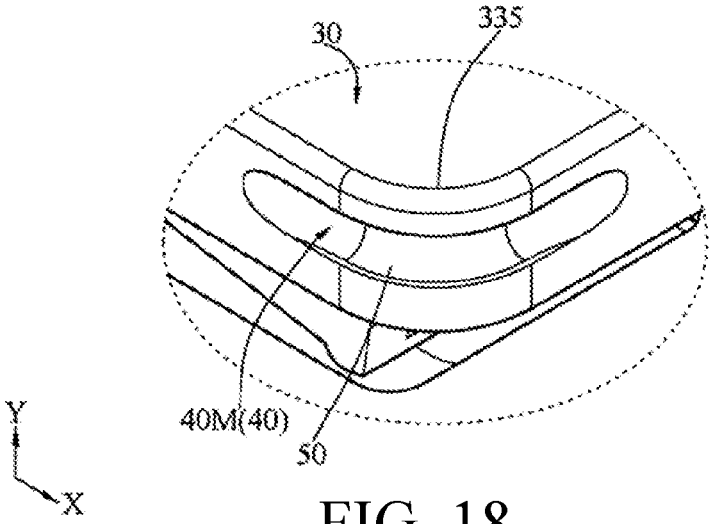
FIG. 18 is a partially enlarged diagram of a circle B in FIG. 17.

Referring to FIG. 17 and FIG. 18, this embodiment is largely the same as the embodiments shown in FIG. 14 and FIG. 15, the fitting portion 40 in this embodiment is a groove 40M defined by a plurality of groove inner surfaces 50, and the groove 40M is located in each corner 335 of the keycap 30. The groove inner surface 50 of the groove 40M in this embodiment is a single and continuous arc surface, and two ends of the groove inner surface 50 form an angle of approximately 90 degrees. In this way, a radian of the groove inner surface 50 continuously varies in the up-to-down direction Y and the horizontal direction X. The foot portions A1 of the key puller A or the hand of the user applies a force on the groove 40M at each of the four corners 335 corresponding to the keycap 30, so that use requirements in different space are met, and the single-arc groove inner surface 50 forming the groove 40M provides more comfortable use feelings.

Figure 19:
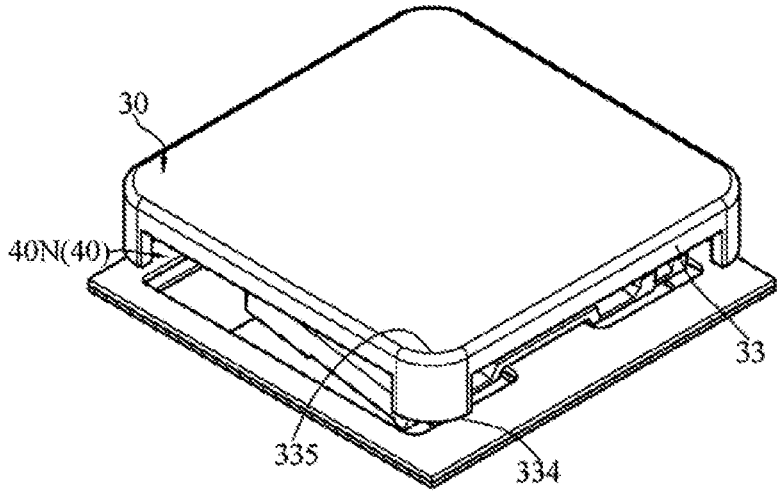
FIG. 19 is a schematic diagram of an embodiment in which a fitting portion of a key structure according to the disclosure is notches and is disposed at a positions between corner.

Referring to FIG. 19, in an embodiment, the fitting portion 40 is a notch 40N. Therefore, the notch 40N is disposed between each two of four corners 335 of the keycap 30, and the notch 40N runs through the rim 33, and extends to and opens at the bottom end 334 of the rim 33 of the keycap 30. In this case, the four corners 335 of the keycap 30 become the open notch 40N to provide a position for forcing on the four corners of the keycap 30 by the foot portions A1 of the key puller A or the hand of the user. Because the notch 40N in this embodiment is open at the bottom end 334 of the rim 33 to which the notch 40N extends, the fitting portion 40 in this embodiment occupies a relatively large area, so that the user can hold or apply a force more smoothly.

Figure 20:
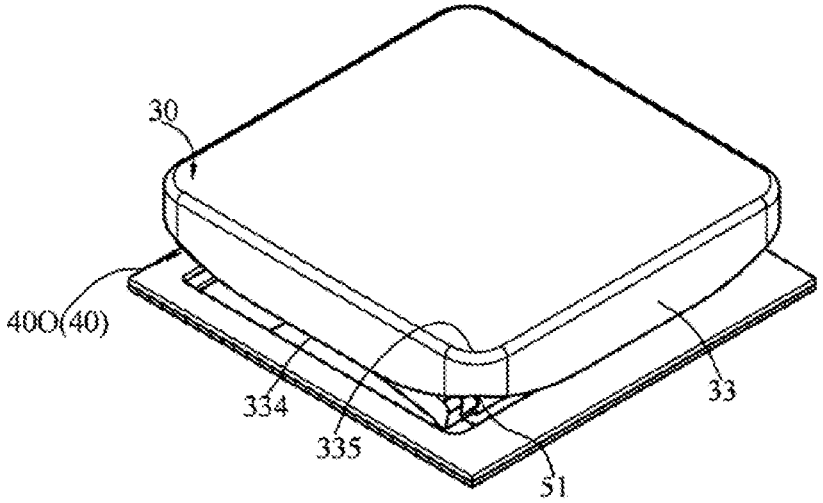
FIG. 20 is a schematic diagram of an embodiment in which a fitting portion of a key structure according to the disclosure is notches and is disposed at corners.
Figure 21:
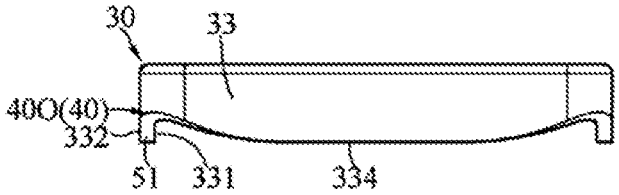
FIG. 21 is a side view of FIG. 20.

Referring to FIG. 20 and FIG. 21, in an embodiment, the fitting portion 40 is a notch 40O. Therefore, the notch 40O is disposed at the bottom end 334 of the rim 33 at a position of each of four corners 335 corresponding to the keycap 30, and the notch 40O runs through the rim 33, and extends to and opens at the bottom end 34 of the rim 33. In addition, in this embodiment, the notch 40O includes a boundary-arc surface 51, and the boundary-arc surface 51 is a continuously-varying arc surface relative to the top surface 31 of the keycap 30. In addition, the boundary-arc surface 51 is connected to the inner surface 331 and the outer surface 332, and the boundary-arc surface 51 is a bevel relative to the inner surface 331 and the outer surface 332. The foot portions A1 of the key puller A or the hand of the user applies a force on the groove 40O at each of the four corners 335 corresponding to the keycap 30, so that use requirements in different space are met, and the boundary-arc surface 51 of the notch 40O provides shape and more comfortable use feelings.

Figure 22:
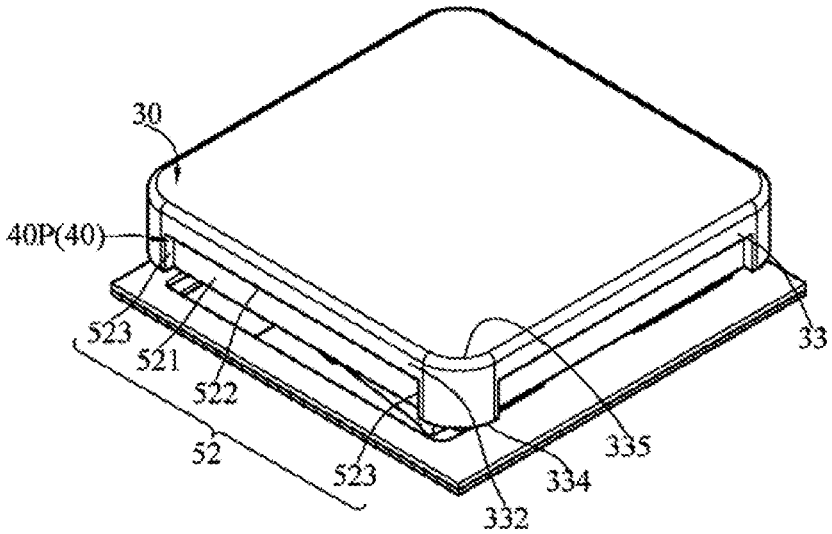
FIG. 22 is a schematic diagram of still another embodiment in which a fitting portion of a key structure according to the disclosure is grooves and is disposed at a position between corners.

Referring to FIG. 22, in an embodiment, the fitting portion 40 is a groove 40P defined by a plurality of groove inner surfaces 52. The groove 40P is located at a position between corners 335 of the rim 33 corresponding to the keycap 30. The groove inner surface 52 includes a first flat surface 521, a second flat surface 522, and two side surfaces 523. An extension direction of the first flat surface 521 is perpendicular to an extension direction of the second flat surface 522, and extension directions of the two side surfaces 523 are respectively perpendicular to the extension directions of the first flat surface 521 and the second flat surface 522. The first flat surface 521 extends to the bottom end 334, and the second flat surface 522 and the side surface 523 extend to the outer surface 332. In this case, the groove 40P is open facing the bottom end 334 and the outer surface 332. The foot portions A1 of the key puller A or the hand of the user applies a force on the groove 40P. The groove 40P in this embodiment extends to and opens at the bottom end 334 and the outer surface 332 of the rim 33, the foot portions A1 or the hand of the user includes a relatively large area to contact with the groove 40P, so that the applied force is smoother and more convenient.

In addition, when the key puller A is used to pull the keycap 30 out, the foot portions A1 of the key puller A do not need to stretch into the interior of the keycap 30, provided that the rim 33 corresponding to the keycap 30 clamps the keycap 30, operation convenience is improved. Further, because in the operation of pulling the keycap 30 out, the key puller A does not need to stretch into the interior of the keycap 30, in the embodiments of the disclosure, during the operation of pulling the keycap 30 out, the user can directly hold the rim 33 of the keycap 30 corresponding to the fitting portion 40, and detach or replace the keycap 30 without a tool, proving very high convenience in use.

Although the present invention is described in the embodiments above, the embodiments are not intended to limit the present invention. Any person of ordinary skill in the art may certainly make some modifications and improvements without departing from the spirit and the scope of the present invention, and the protection scope of the present invention is subject to the protection scope of the claims.

What is claimed is:

1. A key structure, comprising:

a movable support element;

a keycap, comprising a top surface, a bottom surface, and a rim, wherein the bottom surface is jointed with the movable support element, and a periphery of the top surface extends downward to form the rim, the rim comprises an inner surface and an outer surface opposite to each other, the inner surface is connected to the bottom surface, the outer surface is connected to the top surface, the rim further comprises a top end and a bottom end opposite to each other, the top end and the top surface are coplanar; and a fitting portion, located at the outer surface of the rim and connected to the top surface, and operated by an operation body to separate the keycap from the movable support element, the fitting portion comprises a groove, the groove is defined by a plurality of groove inner surfaces, the groove inner surfaces include a first flat surface and a second flat surface connected to each other, the second flat surface is parallel to the inner surface of the rim, and the second flat surface extends to the bottom end of the rim.

2. The key structure according to claim 1, wherein the movable support element comprises a connecting portion, the keycap comprises a joint portion, and the joint portion of the keycap is movably jointed with the connecting portion in a direction perpendicular to the bottom surface.

3. The key structure according to claim 1, wherein the fitting portion is located between the top end and the bottom end.

4. The key structure according to claim 1, wherein the keycap is rectangular and comprises four corners, and the fitting portion is located at positions corresponding to the four corners.

5. The key structure according to claim 1, wherein the fitting portion comprises a magnetic element.

6. The key structure according to claim 1, wherein the fitting portion comprises a plurality of protrusions.

7. The key structure according to claim 1, wherein a friction force of the fitting portion is greater than a friction force of the top surface.

8. The key structure according to claim 1, wherein the fitting portion is made of rubber or a polymer material.

* * * * *